US007246409B2

(12) United States Patent
Moshenrose

(10) Patent No.: US 7,246,409 B2
(45) Date of Patent: Jul. 24, 2007

(54) MANUALLY-POWERED FLOOR SWEEPER WITH VACUUM PORT

(75) Inventor: Paul Moshenrose, Ocean Springs, MS (US)

(73) Assignee: Oreck Holdings, LLC, Cheyenne, WY (US)

( * ) Notice: Subject to any disclaimer, the term of this patent is extended or adjusted under 35 U.S.C. 154(b) by 518 days.

(21) Appl. No.: 10/672,481

(22) Filed: Sep. 26, 2003

(65) Prior Publication Data

US 2005/0066467 A1 Mar. 31, 2005

(51) Int. Cl.
*A47L 7/00* (2006.01)

(52) U.S. Cl. ..... 15/384; 15/352; 15/328; 15/388; 15/349; 15/43

(58) Field of Classification Search ..... 15/383, 15/384, 352, 388, 328, 331, 41.1, 42–43, 15/46, 48, 49.1, 52.1, 246.2, 349, 334
See application file for complete search history.

(56) References Cited

U.S. PATENT DOCUMENTS 1,348,583 A * 8/1920 Rosenfield ..... 15/331
1,759,242 A * 5/1930 Nielsen ..... 15/331
2,306,605 A * 12/1942 Helsing ..... 15/246.2
2,642,617 A * 6/1953 Lilly ..... 15/388
2,960,714 A * 11/1960 Senne ..... 15/349
2,994,098 A * 8/1961 Fukuba ..... 15/388
3,786,532 A * 1/1974 Lindsay ..... 15/388
4,357,727 A 11/1982 McDowell
4,369,539 A 1/1983 Nordeen
4,845,797 A 7/1989 Kobayashi
5,086,539 A * 2/1992 Rench ..... 15/384
5,224,232 A 7/1993 Zahuranec et al.
5,247,720 A * 9/1993 Sovis et al. ..... 15/334
5,970,558 A 10/1999 Canavan et al.
6,539,577 B1 4/2003 Okuda et al.
6,550,099 B2 4/2003 Wörwag
7,150,068 B1 * 12/2006 Ragner ..... 15/384

* cited by examiner

*Primary Examiner*—Theresa T. Snider
(74) *Attorney, Agent, or Firm*—The Ollila Law Group LLC

(57) ABSTRACT

A manually-powered floor sweeper is provided according to the invention. In one embodiment, the manually-powered floor sweeper includes a chassis and handle, one or more agitator rollers rotatably affixed to the chassis and rotated by movement of the floor sweeper, and a vacuum port formed in the chassis and communicating with the one or more agitator rollers and adapted to receive a vacuum hose. Debris picked up and propelled by the one or more agitator rollers is drawn out through the vacuum port when a vacuum is introduced into the vacuum port.

22 Claims, 4 Drawing Sheets

SECTION A-A

MANUALLY-POWERED FLOOR SWEEPER WITH VACUUM PORT

TECHNICAL FIELD

The present invention relates to a cleaning device, and more particularly, to a floor sweeper.

BACKGROUND OF THE INVENTION

A floor sweeper is a light weight, inexpensive device used to pickup debris from surfaces such as floors. A prior art floor sweeper generally includes a handle, a chassis, wheels, a rotating brush, and a collection bin. In operation, a person grips the handle and pushes the floor sweeper around in the area to be cleaned. The wheels rotate in response to the motion, and transmit rotation to the brush. The rotating brush lifts debris off the floor and propels it into a collection bin. The collection bin can be periodically emptied.

Floor sweepers have become increasingly popular. A floor sweeper is manually-powered and therefore does not include heavy and complex components such as motors, vacuum pumps, electrical switches and cords, etc. Moreover, it has few moving parts. As a result, it is inexpensive. In addition, a floor sweeper is lightweight and easily maneuvered. Consequently, a floor sweeper can be quickly taken out, used, and put away. The simplicity and manual power of a floor sweeper results in a device that is light and small.

However, there are drawbacks to floor sweepers in the prior art. Due to the use of a rotating brush to pick up debris, not all debris will be removed from the surface. For example, fine dust may be missed by the brush, and large particles may be too heavy for the brush to propel into a collection bin. Therefore, the pickup action of the prior art floor sweeper is not satisfactory. In addition, the collection bin of a prior art floor sweeper has to be accessed and/or removed in order to be emptied. This requires extra time, and may be difficult to perform without spilling any accumulated debris.

SUMMARY OF THE INVENTION

A manually-powered floor sweeper according to an embodiment of the invention comprises a chassis and handle, one or more agitator rollers rotatably affixed to the chassis and rotated by movement of the floor sweeper, and a vacuum port formed in the chassis and communicating with the one or more agitator rollers and adapted to receive a vacuum hose. Debris picked up and propelled by the one or more agitator rollers is drawn out through the vacuum port when a vacuum is introduced into the vacuum port.

A manually-powered floor sweeper according to an embodiment of the invention comprises a chassis and handle, one or more agitator rollers rotatably affixed to the chassis and rotated by movement of the floor sweeper, one or more collection bins attached to the chassis and positioned to receive material picked up and propelled by the one or more agitator rollers, and a vacuum port formed in the chassis and communicating with the one or more collection bins and adapted to receive a vacuum hose. Debris held in the one or more collection bins is drawn out through the vacuum port when a vacuum is introduced into the vacuum port.

A method of forming a manually-powered floor sweeper is provided according to an embodiment of the invention. The method comprises providing one or more agitator rollers rotatably affixed to a chassis of the floor sweeper and rotated by movement of the floor sweeper and providing a vacuum port formed in the chassis and communicating with the one or more agitator rollers and adapted to receive a vacuum hose. Debris picked up by the one or more agitator rollers is drawn out through the vacuum port when a vacuum is introduced into the vacuum port.

A method of forming a manually-powered floor sweeper is provided according to an embodiment of the invention. The method comprises providing one or more collection bins formed in the chassis of the floor sweeper and positioned to receive material picked up or propelled by one or more agitator rollers and providing a vacuum port formed in the chassis and communicating with the one or more collection bins and adapted to receive a vacuum hose. Debris held in the one or more collection bins is drawn out through the vacuum port when a vacuum is introduced into the vacuum port.

DETAILED DESCRIPTION OF THE INVENTION

Figure 1:
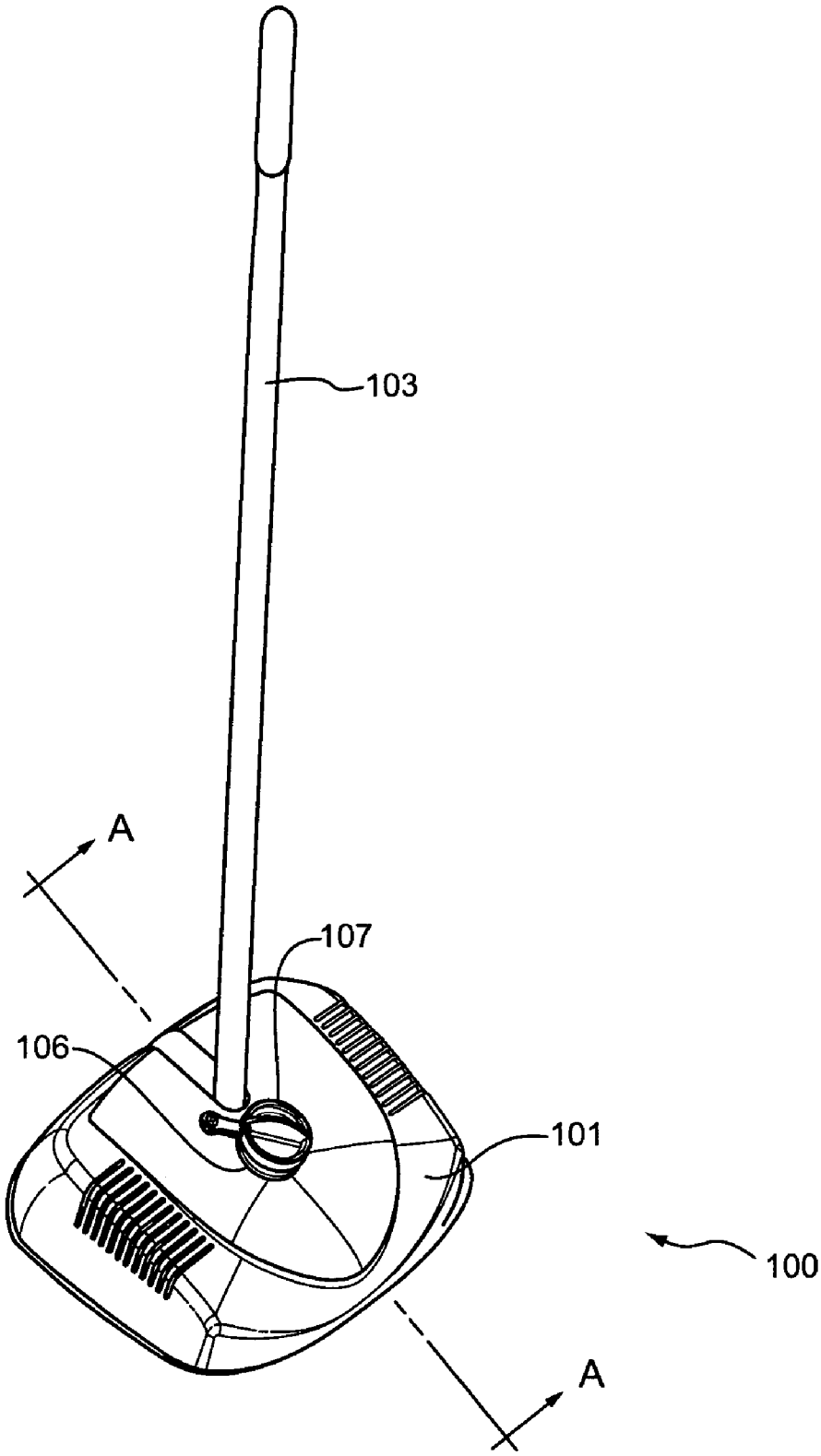
FIG. 1 is an elevation view of a manually-powered floor sweeper according to an embodiment of the invention.

FIG. 1 is an elevation view of a manually-powered floor sweeper 100 according to an embodiment of the invention. The floor sweeper 100 includes a chassis 101, a handle 103 pivotally or movably attached to the chassis 101, a vacuum port 106, and a removable cover 107 for the vacuum port 106.

The vacuum port 106 can be connected to a vacuum source, such as to a vacuum hose of a household vacuum cleaner, for example. The vacuum port 106 can be of a typical vacuum cleaner port size in order to accept a hose from a vacuum cleaner. The vacuum introduced into the vacuum port 106 can be used to augment the cleaning ability of an agitator roller or rollers, and can also be used to empty the debris from an internal collection bin or bins. Detail of the internal components and the operation of the floor sweeper 100 is provided below in FIG. 2 and the accompanying discussion.

In a use typical of a traditional floor sweeper, the vacuum port 106 is closed and blocked by the removable cover 107 and a person pushes the floor sweeper 100 by the handle 103. The manually-powered movement of the floor sweeper 100 on a floor or other surface causes the rotation of an agitator roller (or rollers) in order to pickup and propel debris into an internal collection bin or bins. When in a closed position, the removable cover 107 blocks the vacuum port 106 and the debris therefore cannot escape through the vacuum port 106.

When a vacuum is introduced into the vacuum port 106, the air movement provided by the external vacuum source increases the amount of debris removed from an underlying surface. The floor sweeper 100 can be propelled across the surface while vacuum is provided via the vacuum port 106.

The vacuum augments and improves the debris pickup and removal by the floor cleaner 100. In addition to the superior cleaning provided by the vacuum, the debris collected in the collection bins during any previous operation will be removed by the external vacuum unit as soon as it is connected. This self-cleaning aspect will reduce or eliminate the need to manually empty the collection bins. However, despite this improvement in utility, the floor sweeper 100 remains an effective, inexpensive, simple, and easy to use cleaning device.

Figure 2:
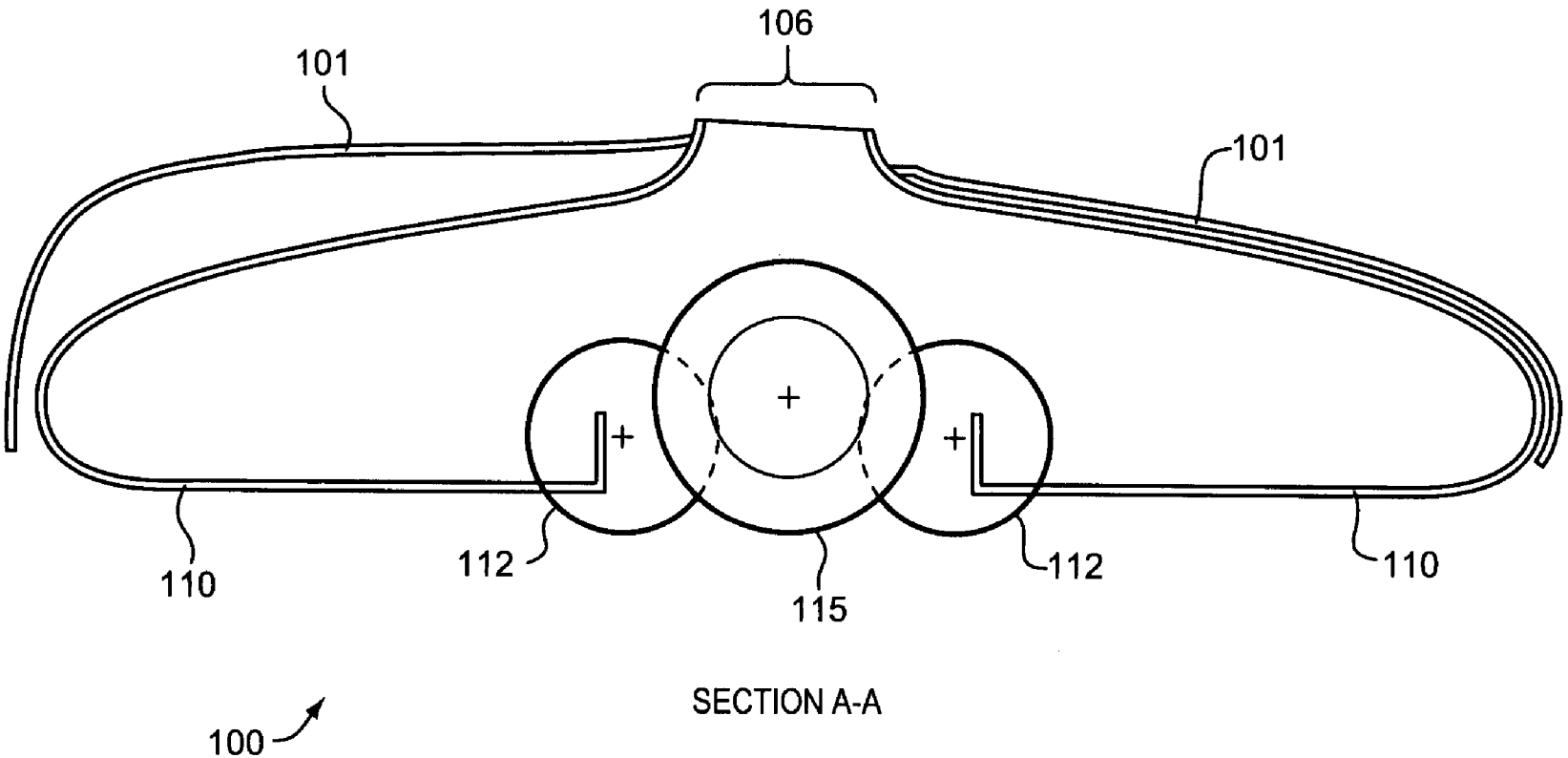
FIG. 2 is a section view of the floor sweeper along the section line AA of FIG. 1.

FIG. 2 is a section view of the floor sweeper 100 along the section line AA of FIG. 1. The floor sweeper 100 in this embodiment includes the chassis 101, the vacuum port 106, two collection bins 110, a single agitator roller 115, and wheels 112. The removable cover 107 is not shown in this figure, but can be included with the floor sweeper 100.

It should be noted that only components essential to the invention are shown in the section view. It should also be noted that the number of agitator rollers 115, collection bins 110, and wheels 112 can vary, and the components depicted are for the purpose of illustration and are not limiting.

The chassis 101 in one embodiment comprises the frame and/or shell of the floor sweeper 100. The chassis 100 provides an external surface and provides a mounting surface for the handle 103, the collection bins 110, etc. It should be understood that the chassis 101 is represented in a simple manner, and the chassis 101 can include other or additional design features, and can vary in shape, size, and appearance.

The agitator roller 115 can comprise any type of rotating agitator, including a rotating brush, a rotating paddle, etc. The agitator roller 115 picks up and propels debris residing on an underlying surface, and can be designed for different sizes/weights/textures/shapes of debris. It should be understood that although only one agitator roller 115 is shown in this embodiment, the floor sweeper 100 can employ multiple rotating agitator rollers 115 if desired.

The wheels 112 carry the floor sweeper 100 over the underlying surface. At least one (or one pair) of the wheels 112 powers the agitator roller 115. The wheels 112 can turn the agitator roller 115 in a manner to oppose or cooperate with the movement of the floor sweeper 100. For example, if the floor sweeper 100 is moving to the left in the figure, the agitator roller 115 can be rotated either clockwise or counter-clockwise. In one embodiment, the wheels 112 comprise rubber. Alternatively, the wheels 112 can comprise a rigid or semi-rigid core material covered by a thickness of rubber or can comprise any material that provides a high level of traction when in contact with the underlying surface.

The collection bins 110 comprise bins that are provided to receive debris picked up and propelled by the agitator roller(s) 115. The collection bins 110 are attached to the chassis 101, and can be permanently or removably attached thereto. The collection bins 110 receive debris when the floor sweeper 100 is propelled over a surface by a user. One or two collection bins are commonly used, depending on the number and location of any agitator roller(s) 115.

The vacuum port 106 is of a predetermined size to accommodate a vacuum hose, as previously described. The vacuum port 106 in one embodiment accepts a typical vacuum hose of a standard household vacuum cleaner.

The vacuum port 106 in one embodiment is located at a position on the chassis 101 to communicate with the agitator roller 115 (including multiple agitator rollers). When a vacuum is introduced into the vacuum port 106, debris that has been picked up and propelled by the agitator roller 115 is drawn out through the vacuum port 106.

The vacuum port 106 in another embodiment is located at a position on the chassis 101 to communicate with the collection bins 110. When a vacuum is introduced into the vacuum port 106, debris held in the collection bins 110 is drawn out through the vacuum port 106.

In yet another embodiment, the vacuum port 106 is located at a position on the chassis 101 to communicate with the agitator roller 115 and with the collection bins 110. When a vacuum is introduced into the vacuum port 106, debris that has been picked up and propelled by the agitator roller 115 and debris held in the collection bins 110 is drawn out through the vacuum port 106.

In one embodiment, the vacuum port 106 is substantially centered above the agitator roller 115 and between the two collection bins 110, as shown. In an embodiment having more than one agitator roller 115 (not shown), the vacuum port 106 can be substantially centered between rollers. In an embodiment having only one collection bin 110, the vacuum port 106 can be offset to be at least partially over the single collection bin 110 and yet positioned so that the airflow into the vacuum port 106 still passes over the agitator roller 115.

In another embodiment, the chassis 101 and the vacuum port 106 can include baffles and other structures (not shown) to guide the airflow and ensure that the airflow empties the collection bins 110 and that the airflow passes over the agitator roller 115. Such baffles and structures can allow for the vacuum port 106 to be non-centered with regard to the agitator roller 115 and/or the collection bins 110. The vacuum port 106 can be non-centered in regard to either or both of a lateral direction (i.e., left-to-right in FIG. 2) and in a transverse direction (i.e., along the axis of the agitator roller 115). In addition, the baffles and structures can split the airflow into multiple streams. For example, baffles and structures can be used to ensure that the airflow extends in both directions along the agitator roller 115.

It should be understood that the vertical distance from the agitator roller 115 to the vacuum port 106 can be varied and still fall within the invention. It should also be understood that the shape and dimensions of a collection bin 110 can be varied and still fall within the invention.

Figure 3:
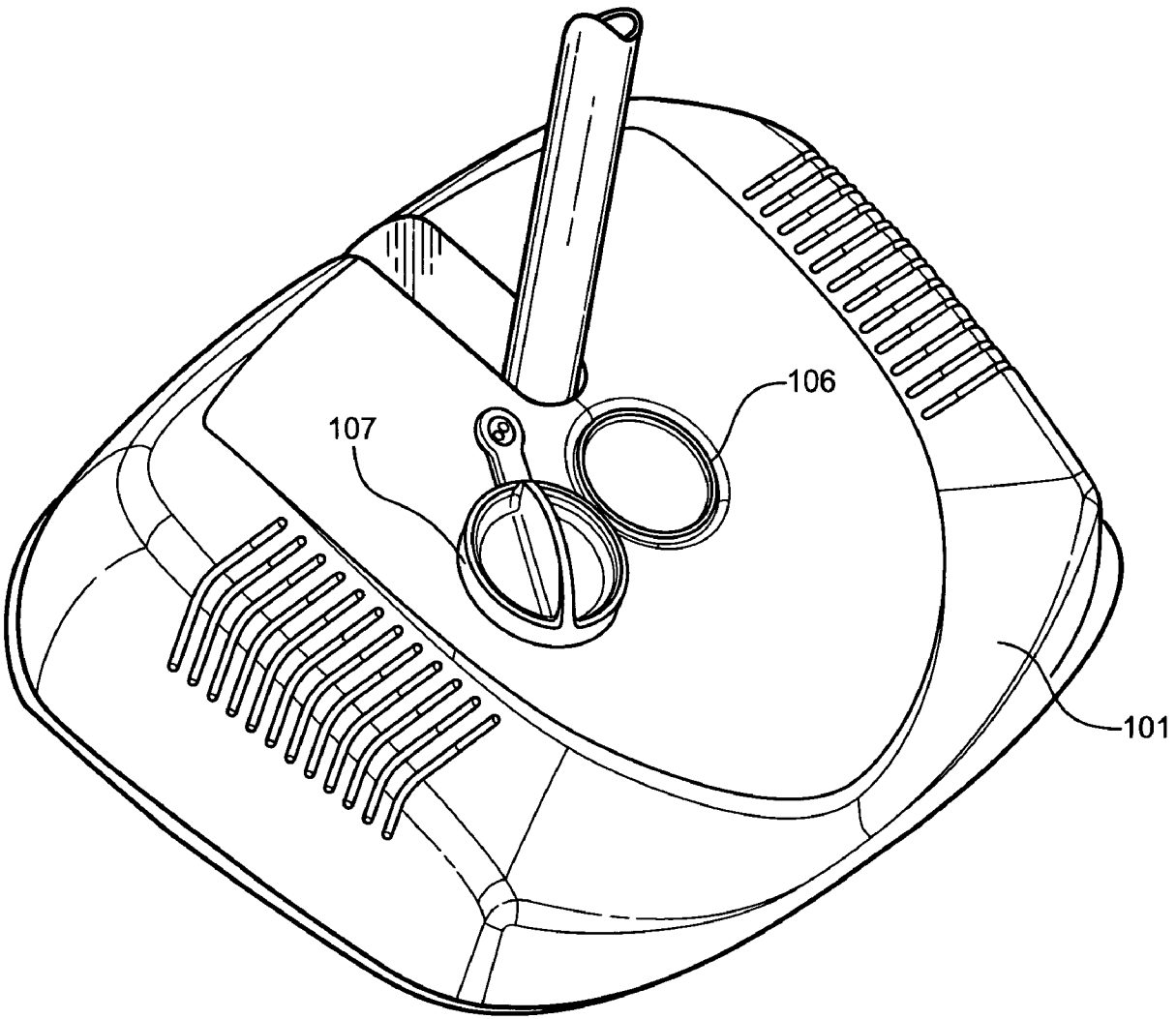
FIG. 3 is an elevation view showing a removable vacuum port cover in an open position.

FIG. 3 is an elevation view showing the removable vacuum port cover 107 in an open position. The removable cover 107 can be placed in an open position, as shown, wherein a vacuum hose can be connected to the vacuum port 106.

In one embodiment, the removable cover 107 is attached to the chassis 101 in some manner. Consequently, the removable cover 107 cannot be lost when in the open position. In one embodiment, the removable cover 107 can be rotatably attached to the chassis 101, as shown, wherein the removable cover 107 can be rotated away from the vacuum port 106. Alternatively, the removable cover 107 can be attached by other means, such as by a cord, lanyard, arm, hinge, etc., that allows the removable cover 107 to be placed in closed and open positions. Alternatively, the removable cover 107 can be a separate, unattached component.

Figure 4:
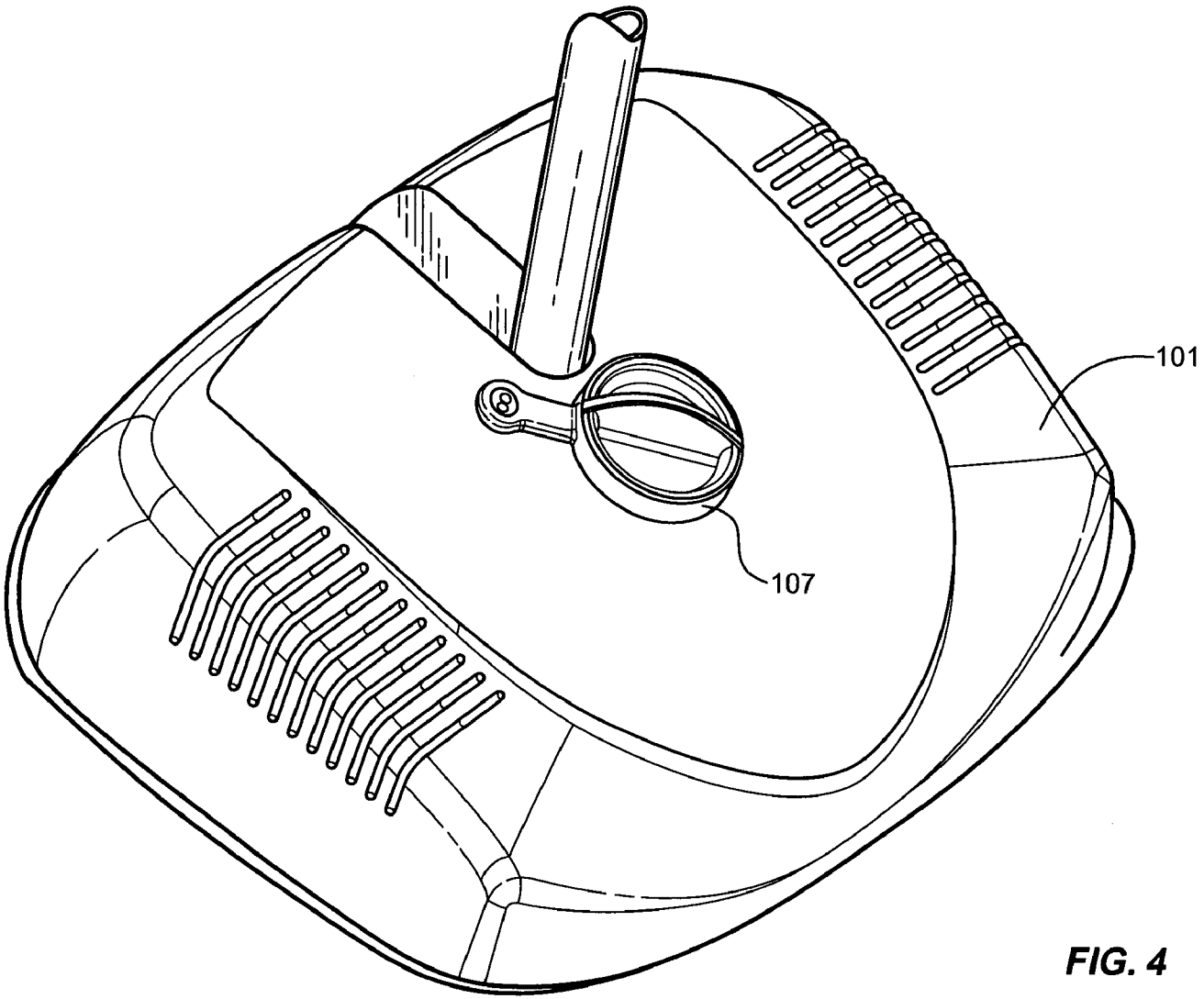
FIG. 4 is an elevation view showing the removable cover in a closed position, wherein the removable cover closes the vacuum port.

FIG. 4 is an elevation view showing the removable cover 107 in a closed position, wherein the removable cover 107 blocks the vacuum port 106. The removable cover 107 prevents debris from being propelled out of the floor sweeper 100 when closed. The removable cover 107 can be formed of any suitable material. The removable cover 107 can fit inside the vacuum port 106 or can fit over the vacuum port 106 in some manner.

The floor sweeper 100 according to any embodiment of the invention provides the benefits of both a manually-powered floor sweeper and a vacuum cleaner. The floor sweeper 100 advantageously requires no power source, and is therefore inexpensive, lightweight, and easy to maneuver and use. The floor sweeper 100 can be operated as a conventional floor sweeper, wherein the floor sweeper 100 is manually pushed over an area and debris picked up by the floor sweeper 100 is held in the one or two collection bins 110. In addition, the floor sweeper 100 can be used as a vacuum cleaner, wherein a vacuum hose is plugged into the vacuum port 106 and the floor sweeper 100 is manually pushed over an area. In this configuration, the vacuum introduced into the floor sweeper 100 further aids in picking up dirt and debris. The use of vacuum improves the efficiency of debris pickup over the agitator roller 115 alone, and enables pickup of larger particles. In addition, the vacuum empties the collection bin(s) 110 during use of the floor sweeper 100. The need to remove the collection bins 110 for emptying is alleviated, along with the accompanying extra time required and the possibility of spilling any accumulated debris.

What is claimed is:

1. A manually-powered floor sweeper, comprising:

a chassis;

a handle attached to and extending from the chassis;

one or more agitator rollers rotatably affixed to the chassis and rotated by movement of the floor sweeper; and a vacuum port formed in the chassis and spaced apart from the handle, with the vacuum port communicating with the one or more agitator rollers and adapted to receive a removable vacuum hose, wherein debris picked up and propelled by the one or more agitator rollers is drawn out, independently from the handle, through the vacuum port, by a vacuum airflow, when the vacuum hose is introduced into the vacuum port.

2. The floor sweeper of claim 1, wherein the vacuum port further comprises a cover that blocks the vacuum port when placed in a closed position.

3. The floor sweeper of claim 1, further comprising one or more collection bins attached to the chassis and positioned to receive debris picked up and propelled by the one or more agitator rollers, wherein the vacuum port further communicates with the one or more collection bins and wherein debris held in the one or more collection bins is drawn out through the vacuum port when a vacuum is introduced into the vacuum port.

4. The floor sweeper of claim 1, wherein the vacuum port is further adapted to receive a vacuum cleaner hose.

5. The floor sweeper of claim 1, further comprising one or more collection bins removably attached to the chassis and positioned to receive debris picked up and propelled by the one or more agitator rollers, wherein the vacuum port further communicates with the one or more collection bins and wherein debris held in the one or more collection bins is drawn out through the vacuum port when a vacuum is introduced into the vacuum port.

6. A manually-powered floor sweeper, comprising:

a chassis and a handle;

one or more agitator rollers rotatably affixed to the chassis and rotated by movement of the floor sweeper;

one or more collection bins attached to the chassis and positioned to receive material picked up and propelled by the one or more agitator rollers; and a vacuum port formed in the chassis and communicating with the one or more collection bins and adapted to receive a removable vacuum hose, wherein debris held in the one or more collection bins is drawn out through the vacuum port when a vacuum is introduced into the vacuum port; and a cover that blocks the vacuum port when placed in a closed position.

7. The floor sweeper of claim 6, wherein the cover fits inside the vacuum port.

8. The floor sweeper of claim 6, wherein the vacuum port further communicates with the one or more agitator rollers and wherein debris picked up and propelled by the one or more agitator rollers is drawn out through the vacuum port when a vacuum is introduced into the vacuum port.

9. The floor sweeper of claim 6, wherein the vacuum port is further adapted to receive a vacuum cleaner hose.

10. The floor sweeper of claim 6, wherein the one or more collection bins are removably attached to the chassis.

11. The floor sweeper of claim 6, wherein the one or more collection bins are formed in the chassis.

12. A method of forming a manually-powered floor sweeper, said method comprising:

providing a chassis;

providing a handle attached to and extending from the chassis;

providing one or more agitator rollers rotatably affixed to the chassis of the floor sweeper and rotated by movement of the floor sweeper; and providing a vacuum port formed in the chassis and spaced apart from the handle, with the vacuum port communicating with the one or more agitator rollers and adapted to receive a removable vacuum hose, wherein debris picked up and propelled by the one or more agitator rollers is drawn out independently from the handle, through the vacuum port, by a vacuum airflow, when the vacuum hose is introduced into the vacuum port.

13. The method of claim 12, further comprising providing a cover capable of closing the vacuum port in a closed position.

14. The method of claim 12, further comprising providing one or more collection bins in the floor sweeper and positioned to receive material picked up and propelled by the one or more agitator rollers, and wherein the vacuum port further communicates with the one or more collection bins and wherein debris held in the one or more collection bins is drawn out through the vacuum port when a vacuum is introduced into the vacuum port.

15. The method of claim 12, wherein the vacuum port is further adapted to receive a vacuum cleaner hose.

16. The method of claim 12, further comprising providing one or more removably attached collection bins in the floor sweeper and positioned to receive material picked up and propelled by the one or more agitator rollers, and wherein the vacuum port further communicates with the one or more collection bins and wherein debris held in the one or more collection bins is drawn out through the vacuum port when a vacuum is introduced into the vacuum port.

17. A method of forming a manually-powered floor sweeper, said method comprising:

providing a chassis;

providing a handle attached to and extending from the chassis;

providing one or more collection bins formed in the chassis of the floor sweeper and positioned to receive material picked up or propelled by one or more agitator rollers; and providing a vacuum port formed in the chassis and communicating with the one or more collection bins and adapted to receive a removable vacuum hose, wherein debris held in the one or more collection bins is drawn out through the vacuum port when a vacuum is introduced into the vacuum port; and providing a cover that blocks the vacuum port when placed in a closed position.

18. The method of claim 17, wherein the cover fits over the vacuum port.

19. The method of claim 17, further comprising providing the one or more agitator rollers rotatably affixed to a chassis of the floor sweeper and rotated by movement of the floor sweeper, wherein the vacuum port further communicates with the one or more agitator rollers and wherein debris picked up by the one or more agitator rollers is drawn out through the vacuum port when a vacuum is introduced into the vacuum port.

20. The method of claim 17, wherein the vacuum port is further adapted to receive a vacuum cleaner hose.

21. The method of claim 17, wherein the one or more collection bins are removably attached to the chassis.

22. The method of claim 17, wherein the one or more collection bins are formed in the chassis.

* * * * *